US008439058B2

(12) United States Patent
Doell

(10) Patent No.: US 8,439,058 B2
(45) Date of Patent: May 14, 2013

(54) ANCHORING SYSTEM FOR PORTABLE SHELTERS AND THE LIKE

(76) Inventor: Glenn E. Doell, Columbus, OH (US)

( * ) Notice: Subject to any disclaimer, the term of this patent is extended or adjusted under 35 U.S.C. 154(b) by 12 days.

(21) Appl. No.: 13/187,134

(22) Filed: Jul. 20, 2011

(65) Prior Publication Data

US 2012/0017960 A1 Jan. 26, 2012

Related U.S. Application Data

(60) Provisional application No. 61/365,835, filed on Jul. 20, 2010.

(51) Int. Cl.
*E04H 15/32* (2006.01)
*E04H 15/62* (2006.01)

(52) U.S. Cl.
USPC ..... 135/120.1; 135/118

(58) Field of Classification Search ..... 135/111, 135/118, 140, 141, 144, 120.1, 16, 96; 160/46, 160/53, 127; 248/346.3, 519, 523, 910, 346.01, 248/346.5, 346.2; 52/163, 165
See application file for complete search history.

(56) References Cited

U.S. PATENT DOCUMENTS

| | | | | | |
|---|---|---|---|---|---|
| 4,148,455 | A * | 4/1979 | Oliver | 248/524 |
| 5,020,764 | A * | 6/1991 | Yamamoto | 248/529 |
| 5,169,111 | A * | 12/1992 | Dunaj | 248/523 |
| 5,207,406 | A * | 5/1993 | Stine et al. | 248/514 |
| 5,615,699 | A * | 4/1997 | Lee | 135/118 |
| 5,638,851 | A * | 6/1997 | Baldwin | 135/124 |
| 5,816,417 | A * | 10/1998 | Reaves | 211/119.01 |
| 6,092,342 | A * | 7/2000 | Sharapata | 52/298 |
| 6,619,610 | B1 * | 9/2003 | Genovese | 248/519 |
| 6,895,982 | B1 * | 5/2005 | Shaw | 135/16 |
| 6,981,680 | B1 * | 1/2006 | Gordon et al. | 248/346.01 |
| 6,986,496 | B2 * | 1/2006 | Roberts et al. | 248/519 |
| 7,353,833 | B1 * | 4/2008 | Palmer | 135/118 |
| 8,082,934 | B1 * | 12/2011 | Kucinski | 135/16 |
| 2010/0258153 | A1 * | 10/2010 | Affolter | 135/96 |
| 2011/0023922 | A1 * | 2/2011 | Rees, Jr. | 135/96 |
| 2011/0180679 | A1 * | 7/2011 | Ma | 248/346.01 |
| 2012/0017956 | A1 * | 1/2012 | Downey et al. | 135/96 |

* cited by examiner

*Primary Examiner* — Noah Chandler Hawk
(74) *Attorney, Agent, or Firm* — Porter Wright Morris & Arthur LLP

(57) ABSTRACT

Disclosed is an anchoring system for a portable shelter that includes a plurality of anchor assemblies each having a support surface for supporting one of the legs of the portable shelter above the ground when the leg rests on the support surface such that the anchor assemblies are positionable under the legs of the portable shelter to support the portable shelter above the ground. Each anchor assembly includes a container, a retainer and an attachment. The container forms a hollow interior space for holding weighting material and has a removable lid forming the support surface. The retainer blocks the leg from sliding off of the support surface. The attachment includes an anchor plate located within the hollow interior space and below the weighting material and a cable extending from the anchor plate and out of the container for attachment to the tensioning line.

18 Claims, 4 Drawing Sheets

ANCHORING SYSTEM FOR PORTABLE SHELTERS AND THE LIKE

CROSS-REFERENCE TO RELATED APPLICATIONS

This application claims the priority benefit of U.S. Provisional Patent Application No. 61/365,835 filed on Jul. 20, 2010, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to portable shelters and, more particularly, to anchor systems for preventing the portable shelters from being displaced or blown over by high winds.

BACKGROUND OF THE INVENTION

Portable shelters such as, for example, canopies, tents, enclosures, gazebos cabanas, screen rooms, and the like are well known. These portable shelters have many applications and are particularly useful in outdoor settings where protection from sun, wind, and/or rain is desired such as at art fairs, craft shows, farmer's markets, trade shows, and the like. Portable shelters typically have an underlying support framework including an overhead truss structure and a plurality legs which support the overhead truss structure in a raised position above the ground. A canopy or roof covering is supported on the overhead truss structure to provide overhead protection to inhabitants of the portable shelter. The sides of the portable shelter can be either open or partially or fully closed by side panels. For an example of a typical portable shelter, see U.S. Pat. No. 7,219,681, the disclosure of which is expressly incorporated herein in its entirety by reference.

One drawback of these portable shelters is that high wind can lift, displace, or even blow over the portable shelters. In order to anchor the portable shelters against wind and the like, an anchor pile or stake is typically passed through a hole formed in a base or foot of each leg and is driven into the ground. Alternately, a pile or stake is driven into the ground adjacent to each leg, and the edge of the canopy is drawn to the piles or stakes with flexible lines, such as ropes or straps, so that the legs are indirectly anchored as they are trapped between the canopy and the ground. On asphalt, concrete, tile, brick, and the like, however, such piling or staking is often difficult and/or not permitted. In such cases, a ballast or weight such as a sandbag or a concrete block has often been placed on the base or foot of each of the legs so as to anchor or weight the legs to the ground. However, these sandbags and concrete blocks are unpleasant to look at and spoil the appearance of the portable shelter, and have poor reliability because they can be easily displaced.

Many attempts have been made to provide improved anchors or ballasts for canopies and the like. For example, see U.S. Pat. Nos. 5,020,764, 5,737,883, 6,981,680, and 7,721,748, the disclosures of which are expressly incorporated herein in their entireties by reference. While these attempts may have been somewhat successful in providing an improvement over using sandbags and concrete blocks, they are much more time consuming to utilize than sandbags and concrete blocks. Accordingly, there is a need in the art for an improved anchoring system for portable shelters that is both effective and easy to use.

SUMMARY OF THE DISCLOSURE

Disclosed are improved anchoring systems for portable shelters which overcome at least one of the above described problems of the prior art. Disclosed is an anchoring system for a portable shelter including a support frame having a plurality of legs and a canopy having a plurality of tensioning lines. The anchoring system comprises, in combination, a plurality of anchor assemblies each having a support surface for supporting one of the plurality of legs above the ground when the leg rests on the support surface such that the plurality of anchor assemblies are positionable under the plurality of legs to support the portable shelter above the ground. Each of the plurality of anchor assemblies includes a container forming the support surface and having a hollow interior space for holding weighting material, a retainer for preventing the leg from sliding off of the container, and an attachment for removably attaching one of the plurality of tensioning lines to the anchor assembly.

Also disclosed is n anchoring assembly for a portable shelter including at least one support leg and at least one tensioning line. The anchoring assembly comprises, in combination, a container having a bottom wall, a generally cylindrically-shaped side wall extending upward from the bottom wall, and a top wall extending from the top of the side wall such that the bottom, side and top walls form a hollow interior space for holding weighting material. The top wall forms a support surface for supporting the leg above the ground when the leg rests on the support surface to support the portable shelter above the ground. A retainer prevents the leg from sliding off of the container. An attachment is provided for removably attaching the tensioning line to the container.

Also disclosed is an anchoring assembly for a portable shelter including at least one support leg and at least one tensioning line. The anchoring system comprises, in combination, a container having a bottom wall, a generally cylindrically-shaped side wall extending upward from the bottom wall, and a removable lid secured to the top of the side wall such that the bottom wall, the side wall, and the lid cooperate to form a hollow interior space for holding weighting material. The removable lid forms a horizontally extending support surface for supporting the leg above the ground when the leg rests on the leg rests on the support surface. A retainer substantially encircles the support surface and extends above the support surface to form an abutment which blocks the leg from sliding off of the support surface. An attachment includes an anchor plate located within the hollow interior space and below the weighting material and a cable extending from the anchor plate and out of the container through an opening in the removable lid for attachment to the tensioning line.

From the foregoing disclosure and the following more detailed description of various preferred embodiments it will be apparent to those skilled in the art that the present invention provides a significant advance in the technology and art of anchoring systems for portable shelters. Particularly significant in this regard is the potential the invention affords for providing a relatively low cost, versatile, and easy to use anchoring system. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
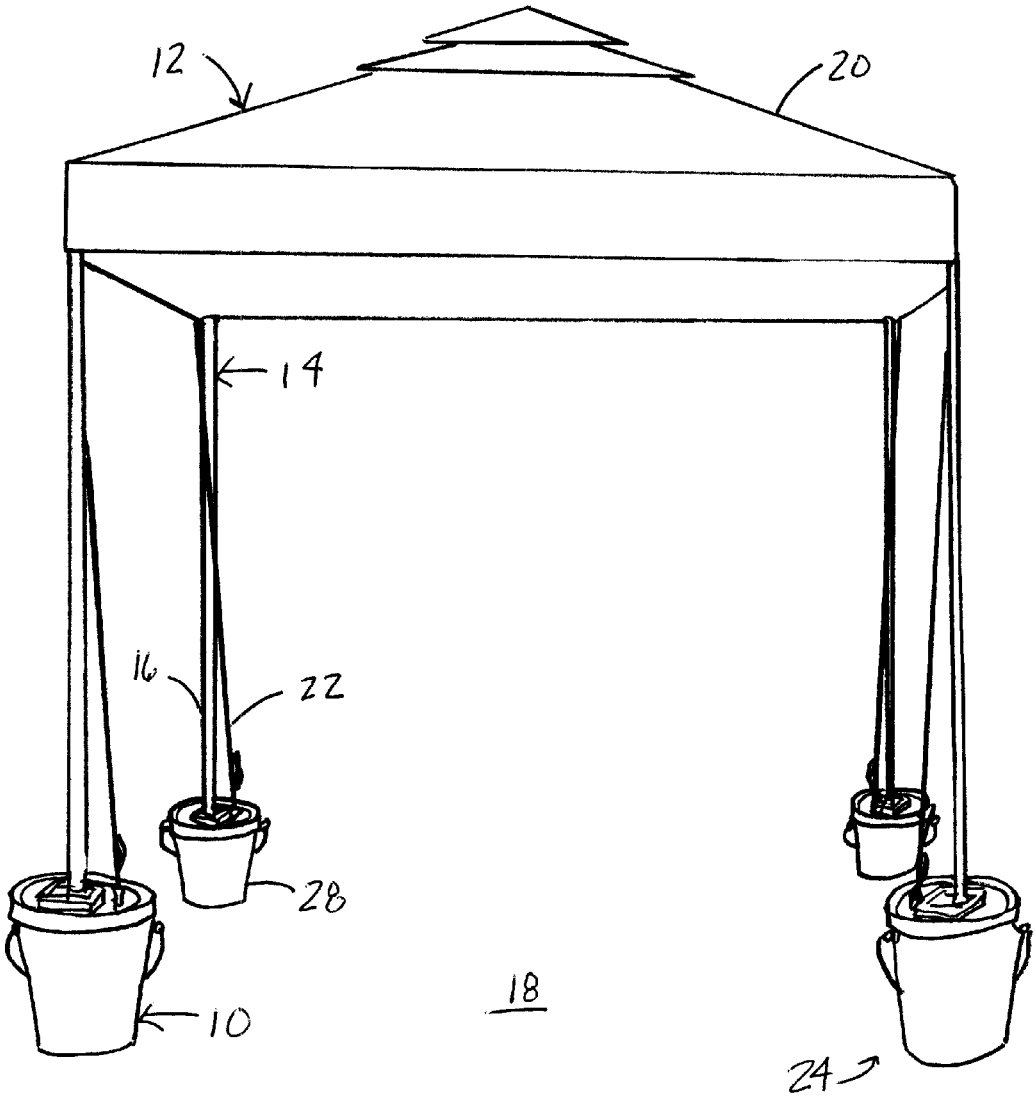
FIG. 1 is a perspective view of a portable shelter utilizing an anchoring system according to the present invention.
Figure 2:
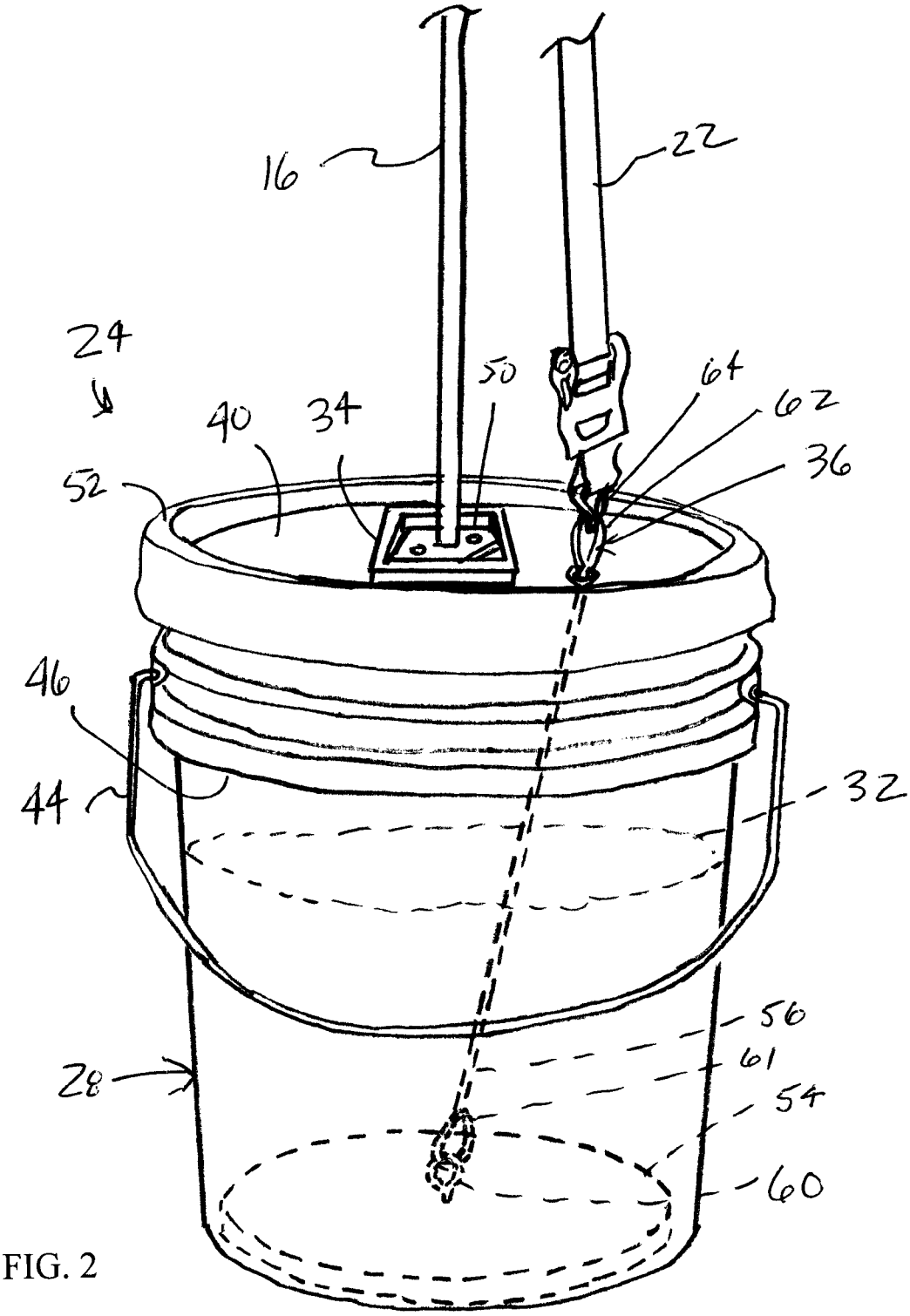
FIG. 2 is an enlarged perspective view of an anchor assembly at the bottom of one leg of the portable shelter of FIG. 1.
Figure 3:
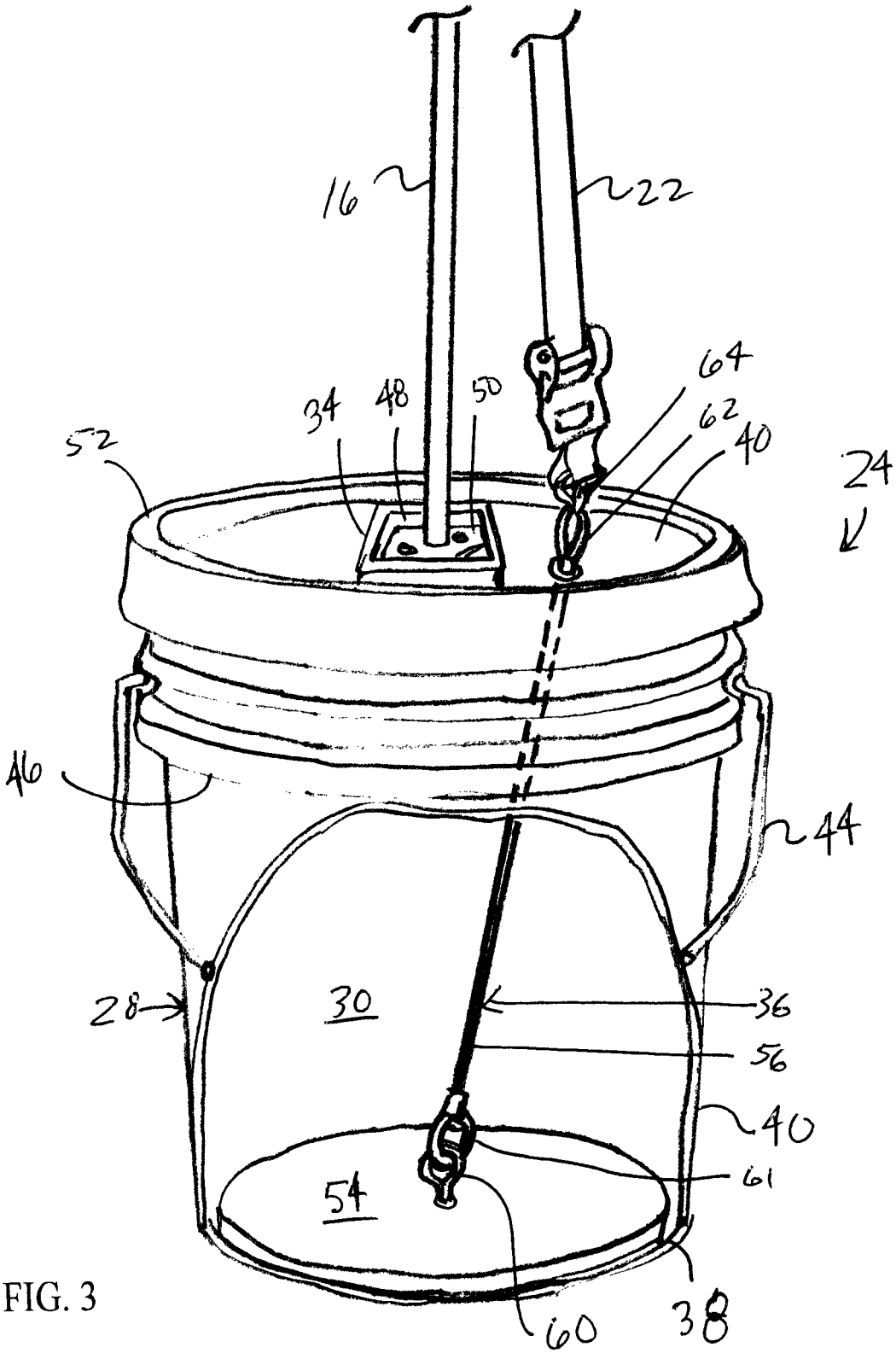
FIG. 3 is another enlarged perspective view of the anchor assembly at the bottom of one leg of the portable shelter of FIG. 1 which is similar to FIG. 2 but has portions of the anchor assembly broken away for clarity of interior components.
Figure 4:
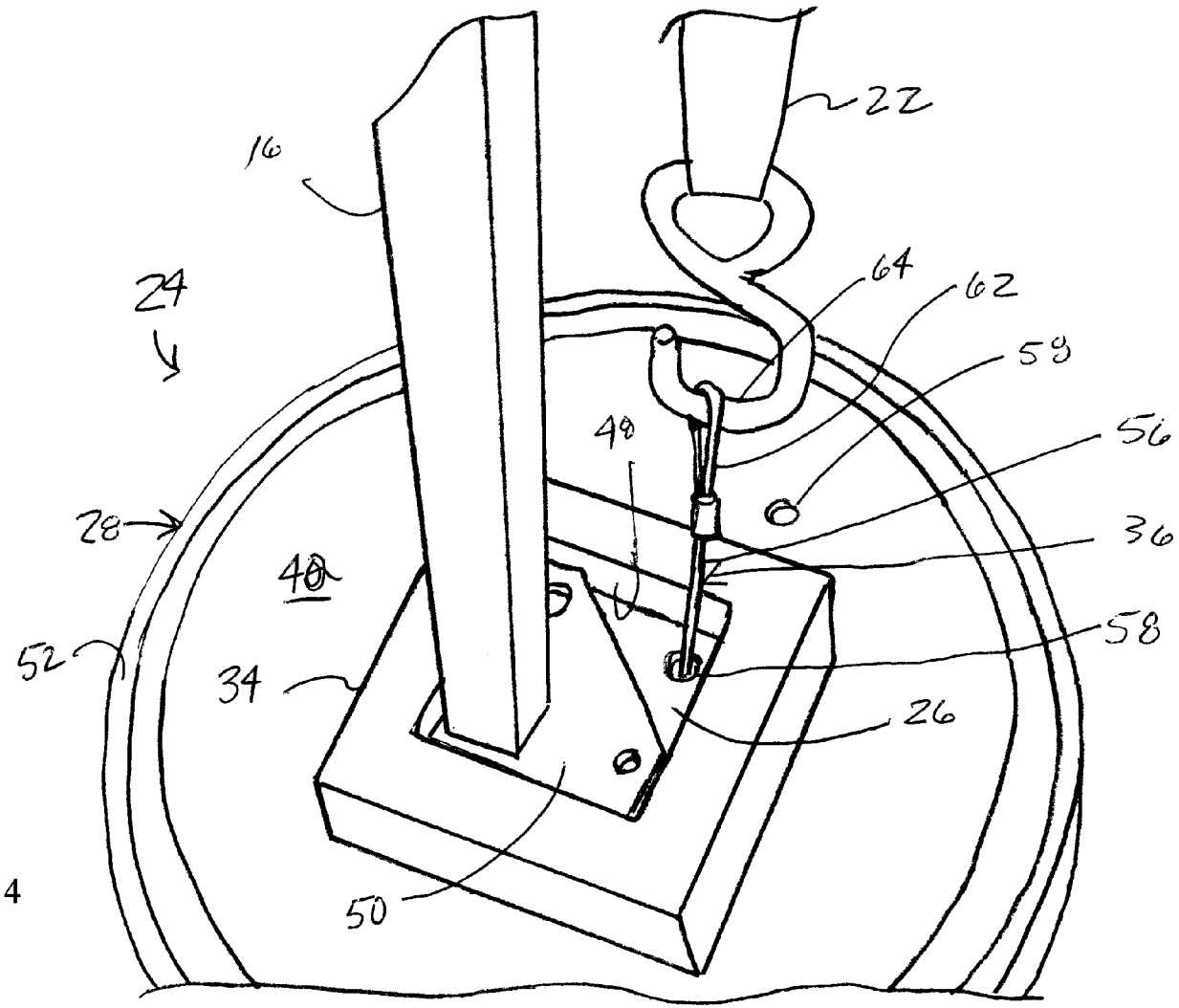
FIG. 4 is an enlarged perspective view of an interface between the bottom of the leg and the anchor assembly of FIGS. 1 to 4.

It should be understood that the appended drawings are not necessarily to scale, presenting a somewhat simplified representation of various preferred features illustrative of the basic principles of the invention. The specific design features of the anchoring systems as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the anchoring systems illustrated in the drawings. In general, up or upward generally refers to an upward direction within the plane of the paper in FIGS. 1 to 3 and down or downward generally refers to a downward direction within the plane of the paper in FIGS. 1 to 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the anchoring systems disclosed herein. The following detailed discussion of various alternative and preferred embodiments will illustrate the general principles of the invention with regard to an anchoring system for a portable shelter. Other embodiments suitable for other applications will be apparent to those skilled in the art given the benefit of this disclosure.

Referring now to the drawings, FIGS. 1 to 4 show an anchoring system 10 for a portable shelter 12 and the like. The illustrated portable shelter 12 is a canopy but can alternatively be a tent, enclosure, gazebo, cabana, screen room, or the like. The illustrated portable shelter 12 includes a support frame 14 having an overhead truss structure and a plurality of legs 16 which vertically extend between the truss structure and the ground 18 to support the truss structure above the ground 18. The illustrated portable shelter 12 also includes a canopy or roof 20 supported on the truss structure and a plurality of tensioning lines 22 extending from the canopy 20 for tensioning the canopy 22 on the truss structure. The illustrated anchoring system 10 includes a plurality of anchor assemblies 24 each having a planar and horizontal support surface 26 for supporting one of the plurality of legs 16 above the ground 18 when the leg 16 rests on the support surface 26 such that the plurality of anchor assemblies 24 are positionable under the plurality of legs 16 to support the portable shelter 12 above the ground 18. Each of the illustrated anchor assemblies 24 includes a container 28 forming the support surface 26 and having a hollow interior space 30 for holding weighting material 32, a retainer 34 for preventing the leg 16 from sliding off of the support surface 26, and an attachment 36 for removably attaching one of the plurality of tensioning lines 22 to the anchor assembly 24.

The illustrated container 28 includes a generally planar and horizontal bottom wall 38, a generally cylindrically-shaped side wall 40 vertically extending upward from the bottom wall 38, and a generally planar and horizontal top wall 42 extending from the top of the side wall 40 such that the bottom, side and top walls 38, 40, 42 cooperate to form the hollow interior space 30. The top wall 42 forms the support surface 26 so that the support surface 26 is located on the top of the container 28. The container 28 preferably has a height suitable to give the portable shelter 12 a more impressive presence when located adjacent other portable shelters not utilizing the anchoring system 10. The container 28 preferably has a height of about 10 inches or more and more preferably a height of about 15 inches or more. The container 28 preferably has a base size suitable to stably support the portable shelter 12 thereon such as for example, a diameter of at least about 10 inches for a height of about 10 inches or a diameter of at least about 12 inches for a height of about 15 inches. It is noted that the container 28 can alternatively have any other suitable configuration and/or sizes. The illustrated containers 28 are able to nest in one another in order to ease transportation and storage.

The weighting material 32 which is inserted into the container 28 can be sand bags, loose sand, gravel, water, or the like. The illustrated hollow interior space 30 is sized to hold a suitable amount of the weighting material 32 and is generally water tight so that it adapted to hold liquid so that the weighting material 32 can be a liquid. It is noted, however, that the container 28 can have any other suitable configuration. For example, the container 28 can have any suitable type of openings if adapted so that the hollow interior space 32 holds only self contained weighting material 23 such as sand bags, water containers, or the like The illustrated top wall 42 is in the form of a removable lid which can be secured and unsecured from the top of the side wall 40. By removing the top lid 42, the weighting material 32 can be easily inserted and removed from the hollow interior space 30 through the top opening. Alternatively, the top wall 42 can be integrally formed with the side wall 40 and not removable from the side wall 40 and alternate means for inserting the weighting material 32 are provided. Alternate means for inserting and removing the weighting material 32 can be, for example, a pluggable or capable opening in the bottom, side or top wall 38, 40, 42, a removable bottom wall 38, or the like.

The illustrated container 28 is provided with a handle 44 for carrying the anchor assembly 24 to and from the location where the portable shelter 12 is to be assembled and used. The illustrated handle 44 is a metal wire handle attached near the top of the side wall 40 of the container 28. The handle 44 is typically secured to about the top three inches of the side wall 40 to provide stability. It is noted that the handle 44 can alternatively have any other suitable configuration and/or can alternatively comprise any other suitable material such as, for example, plastic.

The container 28 is preferably molded of a plastic material such as, for example, polyethylene or the like. It is noted, however, that any other suitable material can alternatively be utilized. It is also noted that container material should have suitable corrosion resistance because the container 28 will typically be used outdoors and may contain water as the weighting material 32.

The illustrated container 28 has the form of a plastic bucket but the container 28 can alternatively have any other suitable configuration. The illustrated plastic bucket has the form of a U.S. standard 5-gallon bucket (sometimes referred to as a 18 to 20 liter bucket) having a height of about 15 inches and a diameter of about 12 inches. This type of container 28 is particularly suitable because the rigidity supplied by the two or three reinforcement collars 46 located near the top. The container 28 can alternatively have a the form of any other suitable bucket such as, for example, a 3.5 gallon bucket having a height of about 10 inches and a diameter of about 10 inches.

The illustrated retainer 34 is located at the support surface 26 of the container 28 to prevent the leg 16 resting thereon from horizontally slipping or sliding off of the container 28 when the leg 16 is resting on the support surface 26. The illustrated retainer 34 is located at the top wall 42 of the container 28 and extends above the support surface 26 to form an abutment or barrier 48 that the leg engages to limit lateral movement of the leg 16 relative to the support surface 26. The illustrated retainer 34 entirely encircles the support surface 26 to form a continuous barrier. It is noted, however, that the retainer 34 only needs to substantially encircle the support surface 26 as long as retainer 34 does not have openings of a size through which the leg 16 can horizontally pass through. The illustrated retainer 34 does not block or otherwise prevent vertical movement of the leg 16 onto or off of the support surface 26. Thus the illustrated leg 16 simply rests on the support surface 26 and is not fastened or secured to the support surface 26 in any manner.

The illustrated retainer 34 is sized to closely receive a foot or base 50 of the leg 16 therein so that there is limited movement of the leg 16 relative to the support surface 26. The retainer 26 has a height that is suitable to block lateral movement of the leg 16 and is preferably has a height greater than the height of the foot or base 50 of the leg 16. The illustrated retainer 34 and resulting support surface 26 formed thereby is substantially smaller than the outer rim 52 of the top wall 42 and is centrally located on the top wall 42 so that the support surface 26 is uniformly spaced from the outer rim 52 of the top wall 42.

The illustrated retainer 34 is integrally molded of plastic with the top wall 42 of the container 28 to form a one-piece component. It is noted, however, that the retainer 34 can alternatively be secured to the container 28 in any other suitable manner and/or the retainer 34 can comprise any other suitable material. The illustrated retainer 34 includes four elongate bar-shaped sections that form a square-shaped recess with the support surface 26 located therein for receiving the foot or base 50 of the leg 16. It is noted that the retainer 34 can alternatively have any other suitable configuration and/or shape.

The illustrated attachment 36 includes an anchor plate 54 located within the hollow interior space 30 and secured to the bottom wall 38 of the container 28 and a flexible line or cable 56 extending from the anchor plate 54 and through an opening 58 in the top wall 42 of the container 28. The anchor plate 54 can be secured to the container 28 in any suitable manner such as, for example, adhesive, fasteners, clips, and the like. It is noted, however, that the anchor plate 54 does not need to be secured to the bottom wall 38 of the container 28 if the weighting material 32 itself will retain the anchor plate 54 at the bottom of the container 28. The illustrated anchor plate 54 is formed of steel or any other suitable material can alternatively be utilized. It is noted that the anchor plate 54 can be eliminated and the cable 56 secured directly to the container 28 when the container 28 is formed to have adequate structural strength but it is preferred to have a more light weight container 28 in combination with the anchor plate 54 for reasons of cost and/or weight.

The flexible cable 56 can be a stranded-wire cable or any other suitable type of flexible cable. The illustrated cable 56 is a stainless steel cable but any other suitable material can alternatively be utilized such as, for example, Nylon or the like. A first or lower end of the flexible cable 56 is secured to the anchor plate 54 within the container 28. The illustrated cable 56 is secured to the anchor plate 54 by swaged loop 61 at the end of the cable 56 and extending through an eye bolt 60 secured to the anchor plate 54 but it can alternatively be secured in any other suitable manner. The second or upper end of the flexible cable 56 is located outside and above the container 28 and is provided with a swaged loop 62 for receiving a hook 64 of the tensioning line 22 for removable attachment the tensioning line t22 o the flexible cable 56. It is noted that the second end of the cable 56 can alternatively be provided with an eyelet, or any other suitable connector for securing the tensioning line 22 thereto. The cable 56 extends through the opening 58 in the top wall 42. The illustrated top wall 42 is provided with a pair of the openings 58 for alternative use. One opening 58 is located within the retainer 34 at the support surface 26 and one opening 58 is located outside the retainer 34 and the support surface 26. Only one of the openings 58 is needed for the cable 58 but the second opening 58 provides an alternative location for passing the cable 56 through the top wall 42. It is noted that it is desirable to have the cable 56 pass through a generally central location such as at the support surface 26, but the size of some legs 16 may prevent passage of the cable 56 through the support surface 26. It is noted that any other suitable quantity and/or location of the openings can e utilized. With the tension line 22 secured to the flexible cable 56, the tensioning line 22 is secured to the container 28 with the framework and legs 16 trapped between the canopy 20 and the anchor assemblies 24.

To install the anchoring system 10 to the portable shelter 12, the anchor assemblies 10 are positioned on the ground 18 at locations at which the legs 16 are to be located. If needed, the weighting material 32 is adjusted within the containers 28 to provide the desired weight. The portable shelter 12 is then lifted and the bottoms of the legs 16 are placed on the top support surfaces 26 of the containers 28 and within the retainers 34. It is noted that the legs 16 simply rest on the top support surfaces 26 of the containers 28 and are not secured directly to the containers 28 in any way. The ends of the tensioning lines 22 are then secured to the attachments 36 and tensioned as needed to trap the framework and legs 36 between the canopy 20 and the anchor assemblies 24.

Any of the features or attributes of the above the above described embodiments and variations can be used in combination with any of the other features and attributes of the above described embodiments and variations as desired.

It is apparent from the above detailed description of the present invention, that the illustrated anchoring system 10 provides a larger footprint to safely secure the portable shelter 12 against wind to any type of surface including asphalt and concrete without penetrating the surface. It is also apparent that the portable shelter 12 is secured with its own internal tensioning system and can be weighted with any of a number of different materials such as, water, sand, sand bags, gravel, and the like. It is further noted that the height of the portable shelter 12 is increased by the height of the containers 28 to give the shelter 12 a more impressive presence. This is particularly the case when the portable shelter 12 is located next to other portable shelters not utilizing the anchoring system 10 at art fairs, craft shows, farmer's markets, trade shows, and the like.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An anchoring system for a portable shelter including a support frame having a plurality of legs and a canopy having a plurality of tensioning lines, the anchoring system comprising, in combination:

a plurality of anchor assemblies each having a support surface for supporting one of the plurality of legs above the ground when the leg rests on the support surface such that the plurality of anchor assemblies are positionable under the plurality of legs to support the portable shelter above the ground;

wherein each of the plurality of anchor assemblies includes a container forming the support surface and having a hollow interior space for holding weighting material, a retainer for preventing the leg from sliding off of the container, and an attachment for removably attaching one of the plurality of tensioning lines to the anchor assembly; and wherein the container includes a bottom wall, a generally cylindrically-shaped side wall extending upward from the bottom wall, and a top wall extending from the top of the side wall such that the bottom, side and top walls form the hollow interior space, and wherein the top wall forms the support surface.

2. The anchoring system according to claim 1, wherein the support surface is substantially planar and horizontally extending.

3. The anchoring system according to claim 1, wherein the retainer extends above the support surface to form an abutment which blocks the leg from sliding off of the support surface.

4. The anchoring system according to claim 3, wherein the retainer substantially encircles the support surface.

5. The anchoring system according to claim 4, wherein the retainer is rectangular-shaped about the support surface.

6. The anchoring system according to claim 1, wherein the top wall is in the form of a removable lid which can be secured and unsecured from the top of the side wall.

7. The anchoring system according to claim 1, wherein the hollow interior space is adapted to hold liquid so that the weighting material can be a liquid.

8. An anchoring system for a portable shelter including a support frame having a plurality of legs and a canopy having a plurality of tensioning lines, the anchoring system comprising, in combination:

a plurality of anchor assemblies each having a support surface for supporting one of the plurality of legs above the ground when the leg rests on the support surface such that the plurality of anchor assemblies are positionable under the plurality of legs to support the portable shelter above the ground;

wherein each of the plurality of anchor assemblies includes a container forming the support surface and having a hollow interior space for holding weighting material, a retainer for preventing the leg from sliding off of the container, and an attachment for removably attaching one of the plurality of tensioning lines to the anchor assembly; and wherein the attachment includes a cable secured within the hollow interior space and extending out of the container for attachment to the tensioning line.

9. The anchoring system according to claim 8, wherein the attachment includes an anchor plate located within the hollow interior space and below the weighting material and the cable extends from the anchor plate and out of the container for attachment to the tensioning line.

10. An anchoring assembly for a portable shelter including at least one support leg and at least one tensioning line, the anchoring system comprising, in combination:

a container having a bottom wall, a generally cylindrically-shaped side wall extending upward from the bottom wall, and a top wall extending from the top of the side wall such that the bottom, side and top walls form a hollow interior space for holding weighting material;

wherein the top wall forms a support surface for supporting the leg above the ground when the leg rests on the support surface to support the portable shelter above the ground;

a retainer for preventing the leg from sliding off of the container, an attachment for removably attaching the tensioning line to the container; and wherein the attachment includes a cable secured within the hollow interior space and extending out of the container through an opening in the top wall for attachment to the tensioning line.

11. The anchoring system according to claim 10, wherein the support surface is substantially planar and horizontally extending.

12. The anchoring system according to claim 10, wherein the retainer extends above the support surface to form an abutment which blocks the leg from sliding off of the support surface.

13. The anchoring system according to claim 12, wherein the retainer substantially encircles the support surface.

14. The anchoring system according to claim 13, wherein the retainer is rectangular-shaped about the support surface.

15. The anchoring system according to claim 10, wherein the top wall is in the form of a removable lid which can be secured and unsecured from the top of the side wall.

16. The anchoring system according to claim 10, wherein the hollow interior space is adapted to hold liquid so that the weighting material can be a liquid.

17. The anchoring system according to claim 10, wherein the attachment includes an anchor plate located within the hollow interior space and below the weighting material and the cable extends from the anchor plate and out of the container through an opening in the top wall for attachment to the tensioning line.

18. An anchoring assembly for a portable shelter including at least one support leg and at least one tensioning line, the anchoring system comprising, in combination:

a container having a bottom wall, a generally cylindrically-shaped side wall extending upward from the bottom wall, and a removable lid secured to the top of the side wall such that the bottom wall, the side wall, and the lid cooperate to form a hollow interior space for holding weighting material;

wherein the removable lid forms a horizontally extending support surface for supporting the leg above the ground;

a retainer substantially encircling the support surface and extending above the support surface to form an abutment which blocks the leg from sliding off of the support surface, and an attachment including an anchor plate located within the hollow interior space and below the weighting material and a cable extending from the anchor plate and out of the container through an opening in the removable lid for attachment to the tensioning line.

* * * * *